US007845145B2

(12) United States Patent
Schroeder

(10) Patent No.: US 7,845,145 B2
(45) **Date of Patent: *Dec. 7, 2010**

(54) METHOD OF PACKAGING AN ARTICLE WITH A CONTAINER

(76) Inventor: Michael D. Schroeder, 6180 Castlebridge Ct., West Chester, OH (US) 45069

( * ) Notice: Subject to any disclaimer, the term of this patent is extended or adjusted under 35 U.S.C. 154(b) by 481 days.

This patent is subject to a terminal disclaimer.

(21) Appl. No.: 11/739,720

(22) Filed: Apr. 25, 2007

(65) Prior Publication Data

US 2007/0193913 A1 Aug. 23, 2007

Related U.S. Application Data

(62) Division of application No. 10/744,348, filed on Dec. 22, 2003, now Pat. No. 7,225,937.

(60) Provisional application No. 60/469,955, filed on May 13, 2003.

(51) Int. Cl.

| | |
|---|---|
| ***B26D 7/27*** | (2006.01) |
| ***B65B 35/30*** | (2006.01) |
| ***B65D 23/12*** | (2006.01) |
| ***B65D 21/02*** | (2006.01) |

(52) U.S. Cl. ..... 53/396; 53/445; 215/10; 215/383; 206/497; 206/499; 220/23.4

(58) Field of Classification Search ..... 53/396, 53/445; 206/217, 497, 730, 734, 514, 804, 206/775, 777; 220/705, 23.2, 23.47, 710, 220/735; 215/383, 391, 10, 386–390; 229/103.1
See application file for complete search history.

(56) References Cited

U.S. PATENT DOCUMENTS

| | | | | |
|---|---|---|---|---|
| 180,132 | A | 7/1876 | Hoard et al. | |
| 251,566 | A | 12/1881 | Fuller | |
| 353,600 | A | 11/1886 | Sloan | |
| 1,270,512 | A * | 6/1918 | Greaza | 132/308 |
| 1,993,978 | A | 3/1935 | Plochman | |
| D100,412 | S | 7/1936 | Carp | |
| 2,780,225 | A | 2/1957 | Barr et al. | |
| 3,332,567 | A * | 7/1967 | Pugh, Sr. | 215/388 |
| 3,369,688 | A | 2/1968 | Dike | |
| 3,445,033 | A * | 5/1969 | Sweet et al. | 220/705 |
| 3,732,999 | A | 5/1973 | Rounkles | |

(Continued)

FOREIGN PATENT DOCUMENTS

JP 2002120871 A 4/2002

*Primary Examiner*—Sue A Weaver
(74) *Attorney, Agent, or Firm*—Wood, Herron & Evans, LLP

(57) ABSTRACT

A package system which combines an article and a container in an integrated package with the article secured in nested relationship within a recess of the container. The recess has sufficient depth such that portions of the side walls of the container extend outwardly effectively beyond an exposed surface of the article so as to protect the article against damage. Alternatively, the package system includes a pair of spaced columns which are integrally formed with the side wall of the container and which extend outwardly from the side wall. A recess is formed between the column members which is configured to receive an article in nested relationship within the recess. Methods for securing the article in nested relationship within the recess of the container are also disclosed.

12 Claims, 11 Drawing Sheets

U.S. PATENT DOCUMENTS 3,733,002 A * 5/1973 Fujio ..... 215/12.2
4,235,343 A 11/1980 Thompson
4,243,162 A * 1/1981 Klygis ..... 222/530
D270,429 S 9/1983 Anderson et al.
4,458,468 A * 7/1984 Sivilich ..... 53/428
4,640,423 A * 2/1987 Mednis ..... 215/10
D319,181 S 8/1991 Balavich
D319,182 S 8/1991 Balavich
5,050,757 A 9/1991 Hidding et al.
5,054,631 A 10/1991 Robbins, III
5,065,875 A 11/1991 Balavich
5,078,286 A 1/1992 Hashimoto
5,135,116 A 8/1992 Panzetti
5,244,106 A 9/1993 Takacs
5,316,398 A 5/1994 Chandaria et al.
5,351,851 A 10/1994 Powell
5,353,983 A * 10/1994 Miller ..... 229/103.1
D362,799 S 10/1995 Noble
5,460,264 A * 10/1995 Rupert ..... 206/217
5,782,358 A 7/1998 Walker
5,788,076 A * 8/1998 Simmons ..... 206/459.5
6,293,393 B1 * 9/2001 Clay ..... 206/217
6,321,977 B1 * 11/2001 Lee ..... 229/103.1
6,427,890 B1 8/2002 Meng
6,691,439 B1 * 2/2004 Miyashita et al. ..... 40/310
7,225,937 B2 * 6/2007 Schroeder ..... 215/10
2002/0092857 A1 * 7/2002 Chang ..... 220/705
2002/0110623 A1 * 8/2002 Rebhorn et al. ..... 426/120
2002/0144914 A1 * 10/2002 Woskoski ..... 206/217
2003/0201270 A1 * 10/2003 Fahey ..... 220/527
2003/0213707 A1 * 11/2003 Clay ..... 206/217
2004/0262173 A1 * 12/2004 Buesching et al. ..... 206/217

* cited by examiner

METHOD OF PACKAGING AN ARTICLE WITH A CONTAINER

The present application is a divisional application of U.S. patent application Ser. No. 10/744,348, filed Dec. 22, 2003, now issued as U.S. Pat. No. 7,225,937, which claims the filing benefit of U.S. Provisional Application Ser. No. 60/469,955, filed May 13, 2003, the disclosures of which are hereby incorporated herein by reference in their entirety.

FIELD OF THE INVENTION

The present invention relates generally to package systems and, more particularly, to a package system which combines an article and a container in an integrated package with the article secured in nested relationship within a recess of the container.

BACKGROUND OF THE INVENTION

Consumers are showing preference and demand for new ways to eat and drink their meals. In response to this demand, suppliers of beverages and snack foods, for example, have developed new ways of packaging and marketing these items together in a "bundled" package as a convenient meal option for consumers. This allows consumers the convenience of purchasing and handling an integrated package including both a snack item and beverage and provides consumers with convenient "grab and go" portability of their meals. This packaging arrangement also provides significant advantages to the beverage and snack food suppliers as well since it permits them to market newer or less-preferred brands to consumers in a "bundled" package with the supplier's stronger brands. In this way, the beverage and snack food suppliers are able to introduce newer products to the market with less risk and also increase sales of weaker brands by relying on the market strength and consumer desirability of the supplier's stronger brands.

In the past, suppliers have "bundled" snack food and beverage items together by shrink-wrapping, taping or otherwise attaching or packaging the snack food item to the outside of the beverage container. However, this method of packaging presents a significant drawback as it oftentimes leaves fragile snack items susceptible to damage during packaging, transport and distribution of the "bundled" package from the supplier to consumer. Many snacks, such as snack bars, are conventionally packaged inside of a flexible wrapper for such things as protection from environmental factors. This wrapper, however, offers little to no protection in subsequent packaging, transport and distribution of the "bundled" package, and therefore requires a secondary package made of paperboard, corrugated or other packaging processes and materials to protect it. This requires additional equipment, materials and labor which add cost to the product and make the packaging process inefficient.

In the past, other types of "bundled" packages have been offered to consumers as well. For example, suppliers have offered market premiums and various other articles in nested relationship within a recess formed in a wall of a container. In these instances, the container recess is defined by recess walls and the article may be glued or loosely placed within the recess and covered with a transparent film so as to secure and/or protect the item within the recess. However, known configurations of recesses which completely enclose the item and/or the use of a covering film over the item present a significant drawback as the item is typically obscured by shadows within the recess, or condensation or glare which occurs on the film, and so cannot be easily seen by the consumer. Also, such recesses and covering films complicate access and dislodgement of the article by the consumer and typically require hand assembly of the "bundled" package which adds to the cost of the assembled package.

Accordingly, there is a need for an improved package system for combining an article and a container in an integrated package with the article secured in nested relationship within a recess of the container.

SUMMARY OF THE INVENTION

The present invention overcomes the foregoing and other shortcomings and drawbacks of package systems and methods of packaging heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a package system is provided for combining an article and a container in an integrated package with the article secured in nested relationship within an elongated, vertically oriented recess formed in a wall of the container. In accordance with one aspect of the present invention, the recess is configured with a sufficient depth such that portions of the side walls of the container extend outwardly effectively beyond an exposed surface of the article so as to protect the article against damage during packaging, shipping, display and transport of the package system until its use by a consumer. The container may be formed to be vendable from a vending machine or other automatic merchandising system so as to meet the strict size and shape requirements for vendable products.

In one embodiment of the present invention, the elongated recess opens vertically at its opposite ends and is preferably sized and shaped to compliment the shape of the article nested within the recess. In this way, the container and article sufficiently contact each other to allow them to be joined together through an intermediate adhesive or other fixative. The open-ended recess improves visibility of the article within the recess so that light is able to enter the recess through the open ends. The open-ended recess also simplifies the insertion and removal of the article relative to the recess which is particularly advantageous for fragile articles such as snack foods.

According to one aspect of the present invention, the article is secured within the recess through an adhering material which has sufficient adhering capability to reliably adhere the article within the recess during packaging, shipping display and transport of the package system, yet permits easy removal of the article by a consumer when so desired without damage to the article. The article may have one or more tear lines formed in a flexible wrapper which envelopes the article. The tear lines may define a removable portion, i.e., a tear strip, in the wrapper which permits the consumer to easily open the wrapper and access the article by pulling on a pull tab and removing the removable portion of the wrapper.

According to another aspect of the present invention, a polymeric band, tape, film, shrink-wrap or other transparent substrate may be adhered to a portion of the container or wrapped completely around the container so as to at least partially overlie the recess and the nested article. The substrate may also include one or more tear lines which define a removable portion, i.e., a tear strip, in the substrate. The removable portion of the substrate may be generally in registration with the removable portion of the wrapper so that when the pull tab of the wrapper is grasped and pulled by the consumer to access the article, both removable portions of the wrapper and the substrate are removed while the remaining portions of the wrapper and substrate stay attached to the container.

In accordance with another aspect of the present invention, a substrate, such as a transparent polymeric film, is adhered to the container about marginal edges of the substrate so as to completely overlie the recess and one or more articles nested within the recess. The substrate has a recloseable seal of conventional design which permits access to the articles upon opening of the seal. When the seal is thereafter closed, the remaining articles are secured within the recess.

According to another aspect of the present invention, one or more undercuts are formed in the wall of the container which communicate with the recess. Each undercut has a depth which is greater than the depth of the recess to permit one or more fingers to be inserted into the undercut and behind the article to facilitate grasping and removal of the article from the recess. The undercuts are particularly advantageous to prevent damage to fragile articles when such articles are dislodged and removed from the recess by the consumer.

In accordance with yet another aspect of the present invention, the package system includes a pair of spaced column members which are integrally formed with a side wall of the container and which extend outwardly from the side wall. An elongated, vertically oriented recess is formed between the column members which opens vertically at its opposite ends. The recess is configured to receive an article in nested relationship within the recess such that outermost portions of the column members extend outwardly effectively beyond the exposed surface of the article when the article is received within the recess so as to protect the article. The column members may have many various shapes and sizes and provide an additional advantage when one package system is stacked on top of a similarly configured package system. The column members add structural integrity to the package system to resist vertical compression of stacked package system and also add increased lateral crush resistence to the package system.

The above and other objects and advantages of the present invention shall be made apparent from the accompanying drawings and the description thereof.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENTS

Figure 1B:
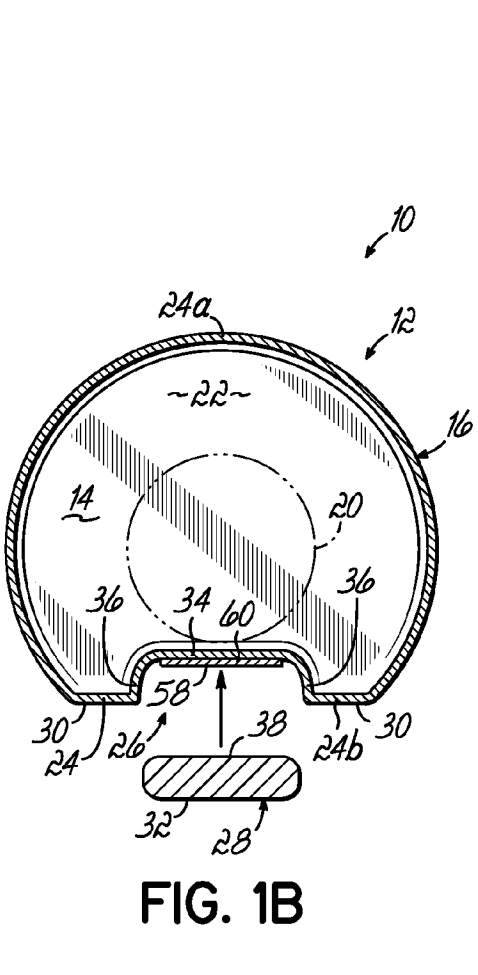
FIG. 1B is a cross-sectional view of the package system of FIG. 1, taken along line 1B-1B of FIG. 1.
Figure 1A:
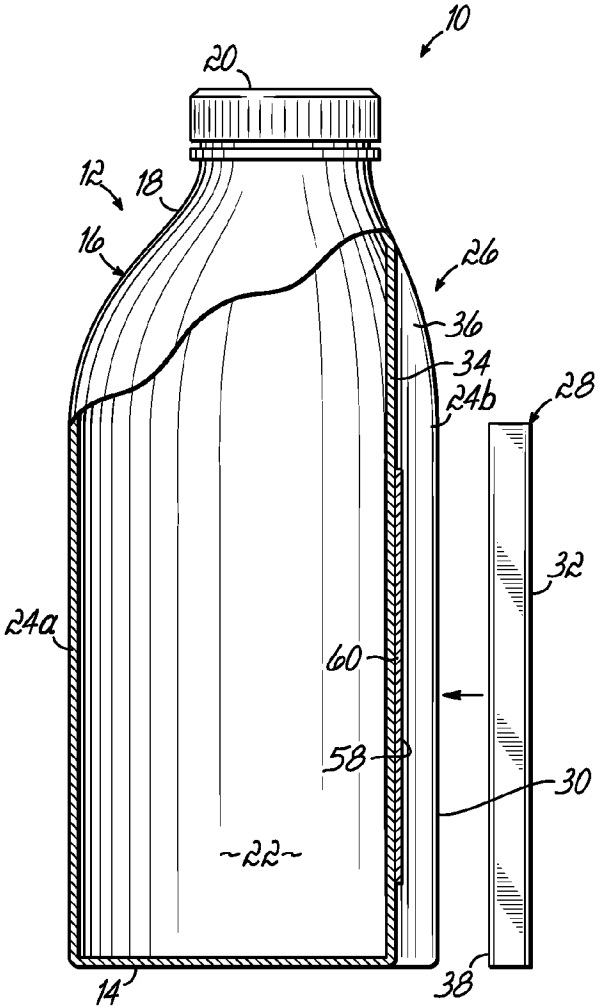
FIG. 1A is cross-sectional view of the package system of FIG. 1, taken along line 1A-1A of FIG. 1, showing insertion of the article within the recess of the container.
Figure 1:
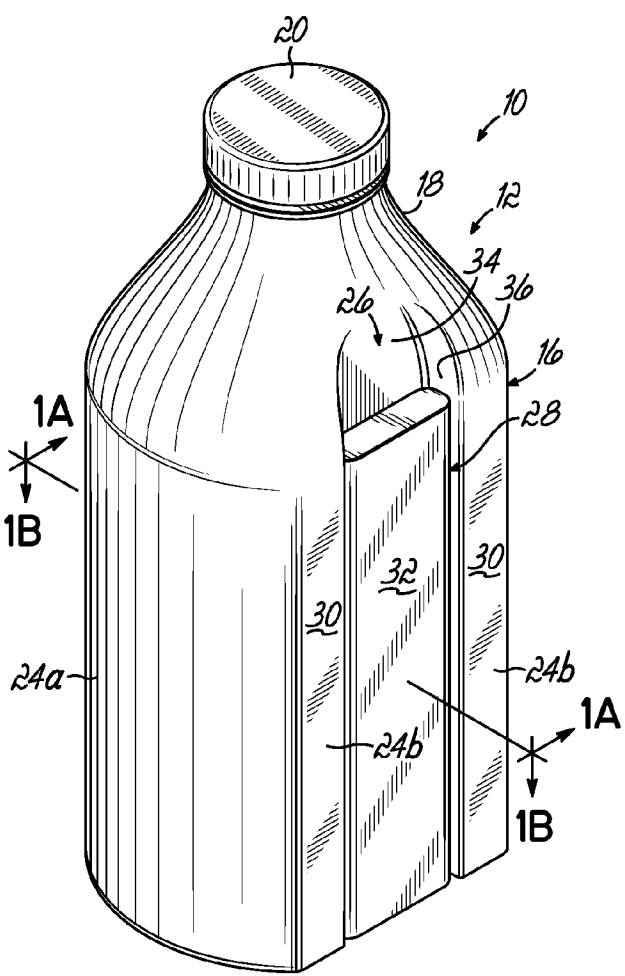
FIG. 1 is a perspective view of a package system in accordance with one embodiment of the present invention including a container and an article secured in nested relationship within a recess of the container.

Referring now to the Figures, and to FIGS. 1, 1A and 1B in particular, a package system 10 is shown in accordance with one embodiment of the present invention. The package system 10 includes a sealed container 12 having a bottom wall 14 and an upstanding side wall 16 which, in one embodiment, converges at an upper end of the container to define a container neck 18. The neck 18 of the container 12 provides an opening (not shown) into the body of the container 12 and is sealed in a conventional manner by an internally threaded cap 20 mating with external threads (not shown) provided on the container neck 18.

Figure 14B:
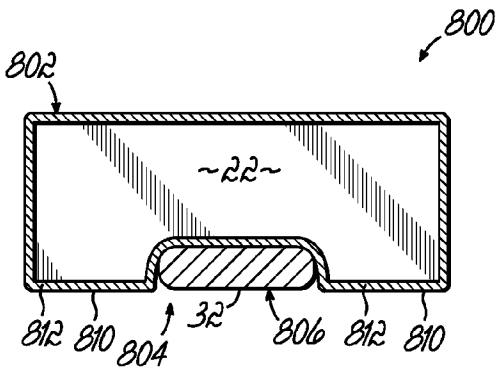
FIG. 14B is a cross-sectional view of the package system of FIG. 14, taken along line 14B-14B of FIG. 14.
Figure 14A:
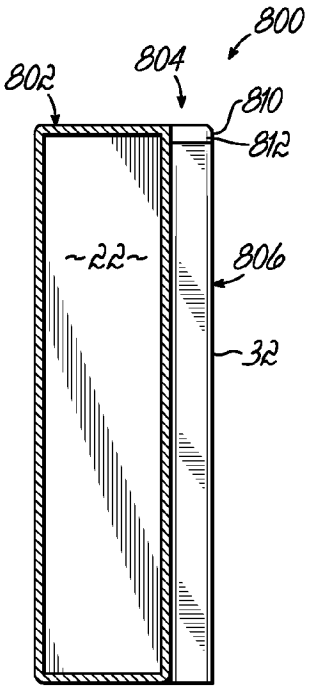
FIG. 14A is a cross-sectional view of the package system of FIG. 14, taken along line 14A-14A of FIG. 14.
Figure 14:
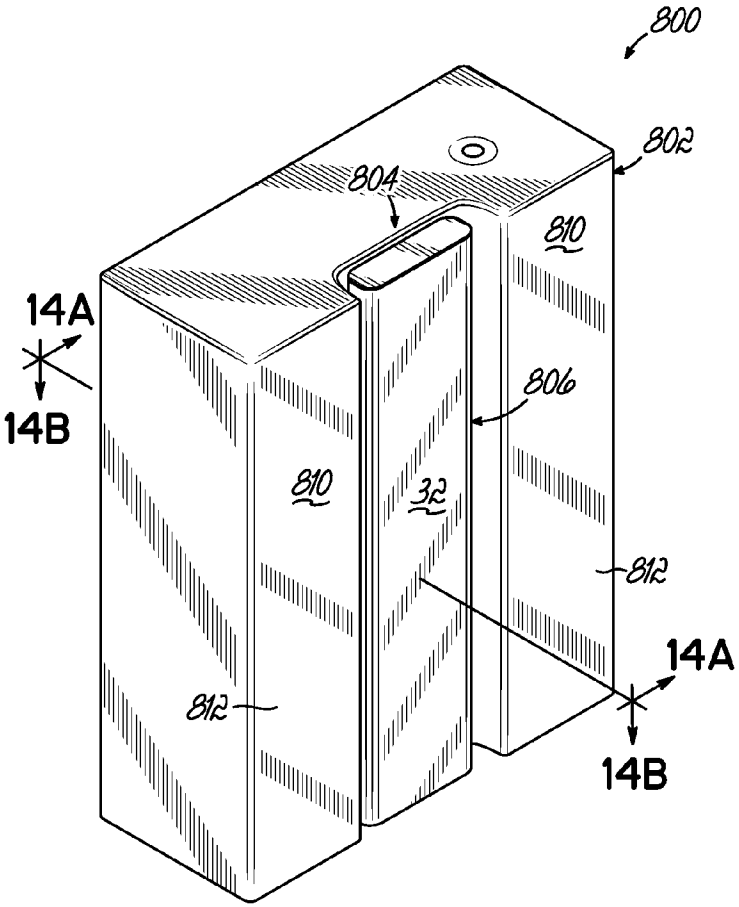
FIG. 14 is a perspective view of a package system according to an alternative embodiment of the present invention showing a carton container and an article secured in nested relationship within a recess of the container.

The container 12 may comprise a generally rigid glass or molded plastic bottle, jar, metal can or carton by way of example. Alternatively, the container 12 may comprise a flexible package such as a bag, stand-up pouch, aseptic package or squeeze tube, or any other suitable type of rigid or flexible container known by those of ordinary skill in the art having an internal cavity 22 (FIG. 1A) which is adapted to safely store the contents of the container 12 for an extended period of time until use of the package system 10 by a consumer. In the case of generally rigid cartons and flexible containers, it will be appreciated that the container may not have a neck as described above. Instead, the container may have converging side walls that are glued or otherwise sealed or joined together at the top of the container, or the container may be folded into a box-like shape having a flat top as shown in FIGS. 14, 14A and 14B, so that the top of the container can be peeled or cut open, opened through a conventional recloseable seal, or pierced with a straw by way of example.

The container 12 may be filled with a variety of different liquids such as fruit juice, milk, isotonics, water, beer, a soft drink, petroleum products or other liquid chemical products, by way of example. Alternatively, as will be described in detail below, the container 12 may be filled with a variety of different loose solids such as salty snacks, sweet snacks, cereal, nuts, granola and dried fruit, toys, trinkets or various chemical products by way of example.

In the package system 10 shown in FIGS. 1, 1A and 1B, the container 12 has an arcuate side wall 24*a* and a generally flat side wall 24*b*, although it will be appreciated that the container 12 and its walls may have many various shapes and sizes without departing from the spirit and scope of the present invention as will be described in greater detail below. It is contemplated that the container 12 may be formed to be vendable from a vending machine or other automatic merchandising system so as to meet the strict size and shape requirements for vendable products.

In accordance with one aspect of the present invention, the package system 10 includes at least one elongated, vertically oriented recess 26 (one shown) which is formed in the generally flat side wall 24*b* of the container 12 and is configured to receive an article 28 within the recess 26 so that the article 28 is supported or contained in nested relationship within the recess 26. The article 28 may comprise a variety of different packaged or wrapped solids or loose solids, such as described above, or an energy bar, snack bar, granola bar, a market premium or some other type of suitable edible or non-edible article. Alternatively, the article 28 may be a rigid or flexible container, such as a bag, stand-up pouch, aseptic package, squeeze tube or carton by way of example, which contains a variety of different liquids as will be described in greater detail below in connection with the package system embodiment of FIGS. 9 and 9A.

In accordance with the principles of the present invention, the recess 26 is configured with a sufficient depth such that portions 30 of the side wall 24*b* of container 12 extend outwardly effectively beyond an exposed surface 32 of the article 28 so as to protect the article 28 against damage during packaging, shipping, display and transport of the package system 10 until its use by a consumer. While the portions 30 of the side walls 24*b* are shown in FIGS. 1, 1A and 1B as extending entirely beyond the exposed surface 32 of the article 28, it shall be understood that the portions 30 of the side wall 24*b* need only effectively, i.e., not entirely, extend beyond the exposed surface 32 of the article 28 so as to provide the desired protection of the article 28 in accordance with the principles of the present invention.

Further referring to FIGS. 1, 1A and 1B, and in accordance with another aspect of the present invention, the elongated recess 26 opens vertically at its opposite ends and is defined by a recessed wall 34 and a pair of elongated side walls 36 which extend between the recessed wall 34 and the generally flat side wall 24*b* of the container 12. The recess 26 is preferably sized and shaped to complement the shape of the article 28 nested within the recess 26 so that the recessed wall 34 is generally congruent with an inner surface 38 of the article 28. In this way, the container 12 and article 28 sufficiently contact each other to allow them to be joined together through an intermediate adhesive or other fixative as will be described below. The open-ended recess 26 provides several distinct advantages, including improved visibility of the article 28 within the recess 26 since light is able to enter the recess 26 through the open ends. The open-ended recess 26 also simplifies insertion and removal of the article 28 relative to the recess as will be described in greater detail below.

Contact of the article 28 with the container 12 also promotes the transfer of thermal energy between the container 12 and the article 28. For example, when the package system 10 is cooled in a refrigerator and subsequently removed, the container 12 will maintain a cool temperature for the article 28 attached within the recess 26 which thereby extends the freshness and usefulness of certain articles such as fruits, vegetables, chocolates or medicines, by way of example, which may be adversely affected from rising temperatures. The article 28 can subsequently be removed from the recess 26 for heating one or both of the article 28 and container 12 as may be desired. Similarly, when the package system 10 is heated, the container 12 will transfer heat energy to the article 28 to keep it warm prior to consumption.

Figure 8:
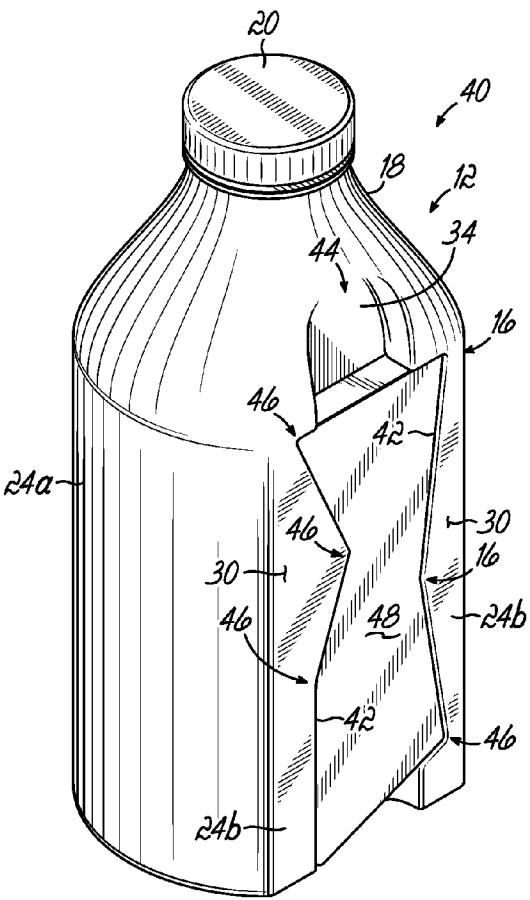
FIG. 8 is a perspective view of a package system according to an alternative embodiment of the present invention showing recesses provided in the side walls of the recess and an article having a complimentary shape to the recesses.

As shown in FIGS. 1, 1A and 1B, the side walls 36 of the recess 26 are generally parallel and extend outwardly from the vertically oriented recessed wall 34, although other configurations of the recessed wall 34 and the side wails 36 of the recess 26 are possible as well. For example, as shown in the alternative package system 40 of FIG. 8, the side walls 42 of the recess 44 include one or more laterally extending recesses 46 which are complementary in shape to the article 48 so that the article 48 is prevented from moving upwardly or downwardly within the recess 44 while providing the desired protection of the article 48. As shown in the alternative package system 50 of FIGS. 9 and 9A, the recessed wall 52 is arcuate and, while not shown, it is contemplated that the side walls 54 of the recess 56 can be made arcuate as well so as to complement a particular shape of an article which may have rounded or bulging sides.

Referring again to the package system 10 of FIGS. 1, 1A and 1B, it will be seen that the article 28 is secured within the recess 26 through an adhering material 58 which has sufficient adhering capability to reliably adhere the article 28 within the recess 26 during packaging, shipping, display and transport of the package system 10, yet permits easy removal of the article 28 by a consumer when so desired without damage to the article 28. In one embodiment, the adhering material may comprise a two-sided adhesive tape 60 (FIGS 1A and 1B) of various forms known to those of ordinary in the art which is applied to the recessed wall 34 of the recess 26 before the article 28 is secured within the recess 26 as will be described in detail below in connection with the automated in-line packaging method of FIG. 12. Alternatively, the adhering material may comprise an ultraviolet or electron beam curable adhesive, cold or hot set adhesive, or any other suitable type of adhesive or fixative material known to those of ordinary skill in the art. The adhering material 58 may be applied to the recessed wall 34 of recess 26 before the article 28 is secured within the recess 26 or, alternatively, to the inner surface 38 of the article 28 which is to confront the recessed wall 34 of the recess 26 when the container 12 and article 28 are joined together as described in detail below. The present invention contemplates any suitable adhering material known by those of ordinary skill in the art which is capable of securing the article 28 within the recess 26.

Figure 6:
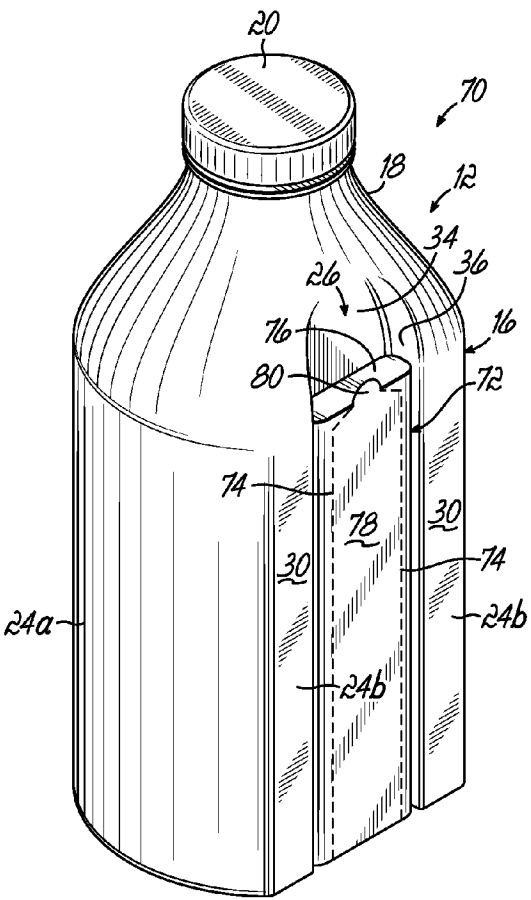
FIG. 6 is a perspective view of a package system according to an alternative embodiment of the present invention showing the article enveloped in a wrapper which has a removable wrapper portion.

As shown in the alternative packaging system 70 of FIG. 6, wherein like numbers represent like parts to the package system 10 of FIGS. 1, 1A and 1B, the article 72 has one or more tear lines 74 formed in a flexible wrapper 76 which envelops the article. The tear lines 74 may define a removable portion 78 in the wrapper 76, i.e., a tear strip, which permits a consumer to easily open the wrapper 76 and access the article 72 by pulling on a pull tab 80 and removing the removable portion 78. Since the wrapper 76 is adhered to the container 12, the remaining portion of the wrapper 76 will remain attached to the container 12. In this way, the tear lines 74 and removable portion 78 provide convenient access to the article 72 within the wrapper 76 so that the article can be removed while the wrapper remains attached to the container 12.

Figure 10:
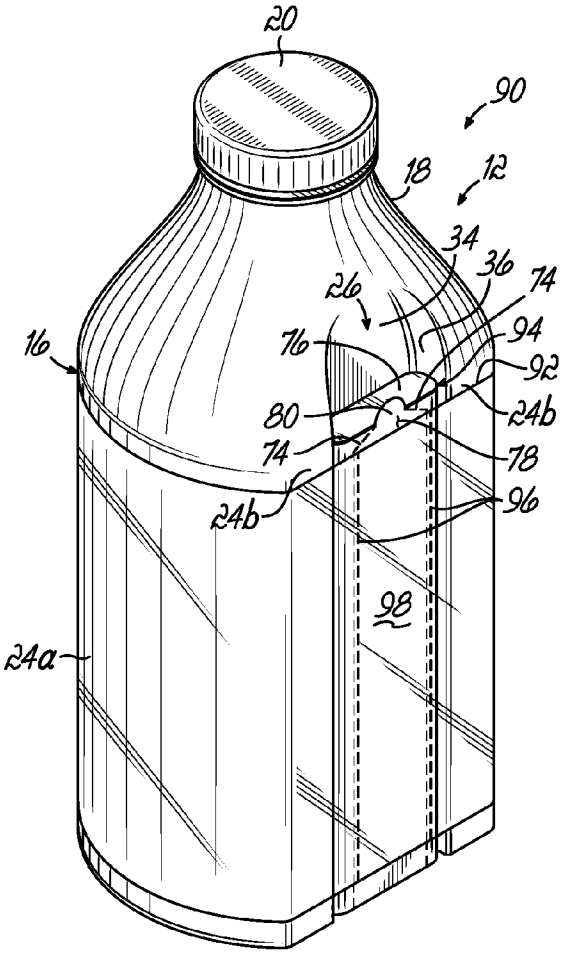
FIG. 10 is perspective view of a package system according to an alternative embodiment of the present invention showing a substrate overlying a portion of the recess and the article.

As shown in the alternative package system 90 of FIG. 10, wherein like numbers represent like parts to the package system 10 of FIGS. 1, 1A and 1B, a substrate 92, such as a polymeric band, tape, film, shrink-wrap or other preferably transparent substrate, is adhered to a portion of the container 12 or wrapped completely around the container 12 so as to at least partially overlie the recess 26 and the nested article 94. The substrate 92 may comprise a label which provides identification of the product to a consumer as well as other product information. In this embodiment, the substrate 92 includes one or more tear lines 96 which define a removable portion 98, i.e., a tear strip, in the substrate 92. The removable portion 98 of the substrate 92 is generally in registration with the removable portion 78 of the wrapper 76 (FIG. 6) so that when the pull tab 80 is grasped and pulled by the consumer to access the nested article 94, both removable portions 78 and 98 of the wrapper 76 and substrate 92 are removed. If the substrate 92 is adhered to one or both side walls 24*a*, 24*b* of the container 12, the remaining portion of the wrapper 76 and substrate 92 will remain attached to the container 12. In this way, the entire substrate 92 does not need to be removed to access the article 94 within the recess 26.

Figure 11:
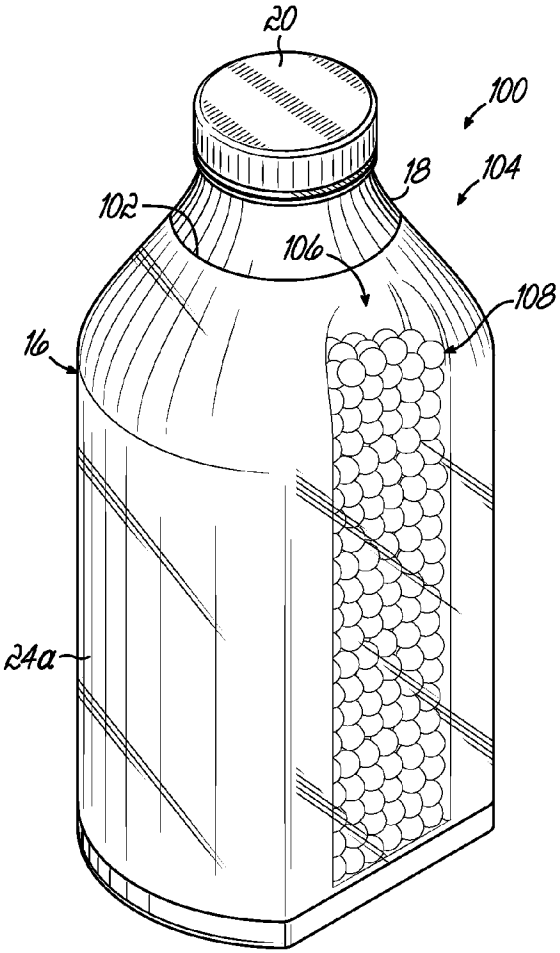
FIG. 11 is a perspective view of a package system according to an alternative embodiment of the present invention showing a substrate completely overlying the recess and the article.

Referring now to the alternative package system 100 of FIG. 11, wherein like numbers represent like parts to the package system 10 of FIGS. 1, 1A and 1B, a substrate 102, such as a polymeric band, tape, film, shrink-wrap or other preferably transparent substrate, is wrapped around the container 104 so as to completely overlie the recess 106 and the nested article 108. The substrate 102 may also contain label information and is provided to secure one or more articles 108 within the recess 106 without requiring the articles to be adhered to the container 104. Alternatively, the article 108 may be adhered to the container 104, with the substrate 102 providing additional security to maintain the article 108 within the recess 106. While not shown, it is contemplated that one or more tear lines could be formed in the substrate 102 to define a removable portion of the substrate 102. Access to the articles 108 within the recess 106 is achieved by simply removing the removable portion of the substrate 102.

Figure 7:
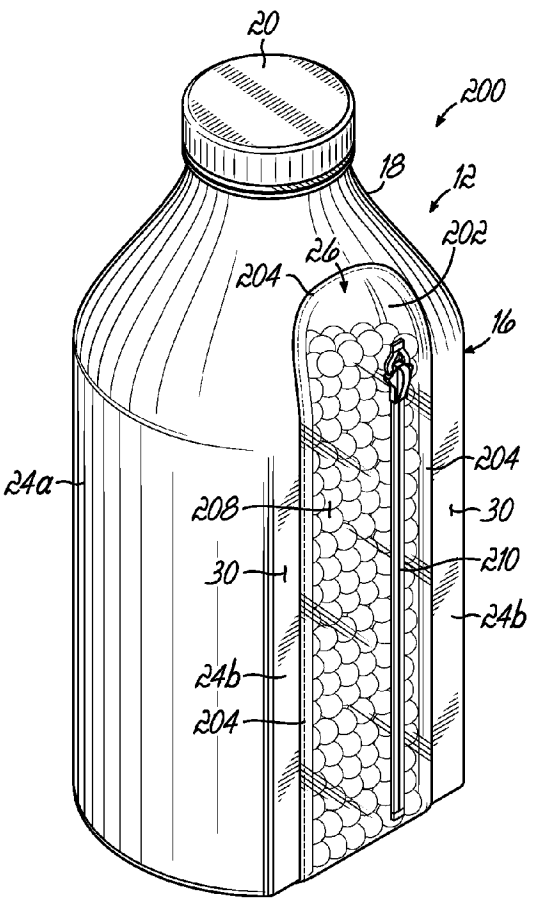
FIG. 7 is a perspective view of a package system according to an alternative embodiment of the present invention showing a substrate completely overlying the recess and the article and a recloseable seal associated with the substrate.

Alternatively, as shown in the package system 200 of FIG. 7, wherein like numbers represent like parts to the package system 10 of FIGS. 1, 1A and 1B, a substrate 202, such as a transparent polymeric film, is adhered to the container 12 about marginal edges 204 of the substrate 202 so as to completely overlie the recess 26 and one or more articles 208 nested within the recess 26. The substrate 202 has a recloseable seal 210 of conventional design which permits access to the articles 208 upon opening of the seal 210. When the seal 210 is thereafter closed, the remaining articles 208 are secured within the recess 26.

Figure 2B:
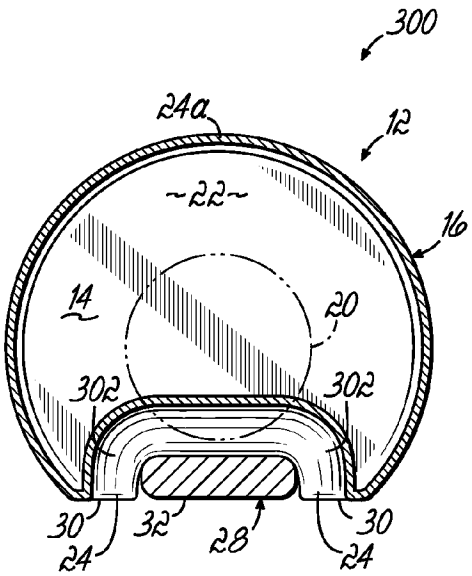
FIG. 2B is a cross-sectional view of the package system of FIG. 2, taken along line 2B-2B of FIG. 2.
Figure 2A:
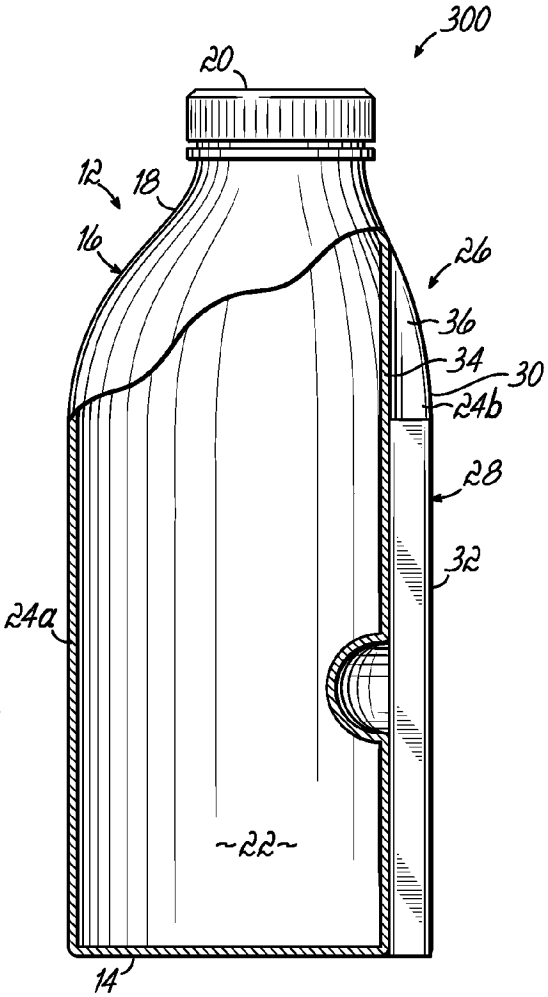
FIG. 2A is a cross-sectional view of the package system of FIG. 2, taken along line 2A-2A of FIG. 2.
Figure 2:
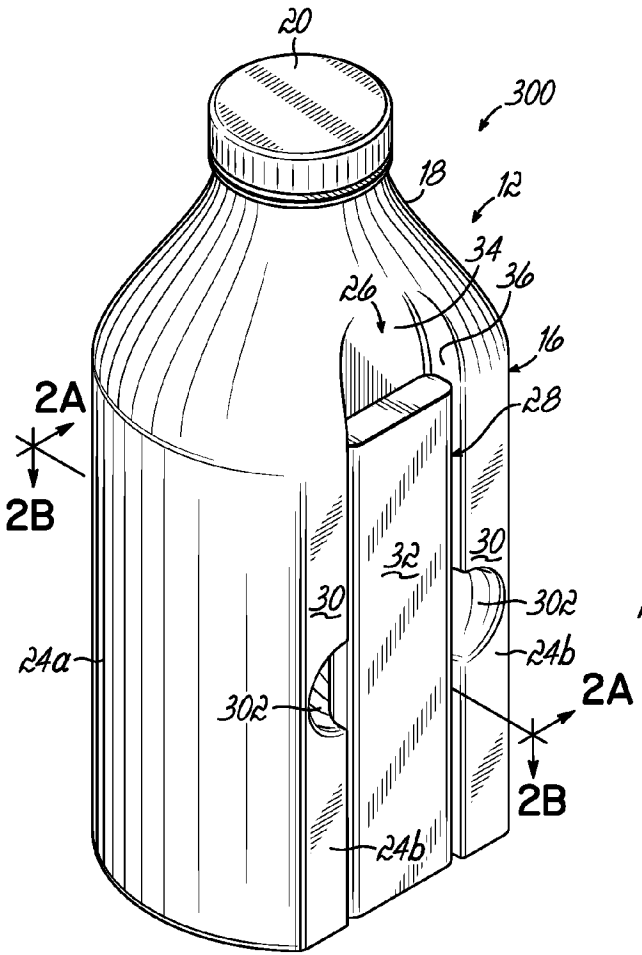
FIG. 2 is a perspective view of a package system according to an alternative embodiment of the present invention showing a pair of undercuts communicating with the recess to facilitate removal of the article from within the recess.

Referring now to FIGS. 2, 2A and 2B, an alternative package system 300 is shown, wherein like numbers represent like parts to the package system 10 of FIGS. 1, 1A and 1B. In this embodiment, one or more undercuts 302 (two shown) are formed in the generally flat side wall 24*b* of the container 12 and which communicate with the recess 26. Each undercut 302 has a depth which is greater than the depth of the recess 26 to permit one or more fingers to be inserted into the undercut and behind the article 28 to facilitate grasping and removal of the article from the recess 26. The use of the undercuts 302 is particularly desirable when the article 28 is fragile so that the article can be easily dislodged from the recess 26 without damage to the article. The undercuts 302 may be connected to extend entirely across the width of the recess 26 as shown in FIGS. 2, 2A and 2B or, alternatively, each undercut 302 may be distinct so as not to join with an opposite undercut 302, yet still provide an advantage for dislodging of the article 28 from the recess 26.

Figure 3B:
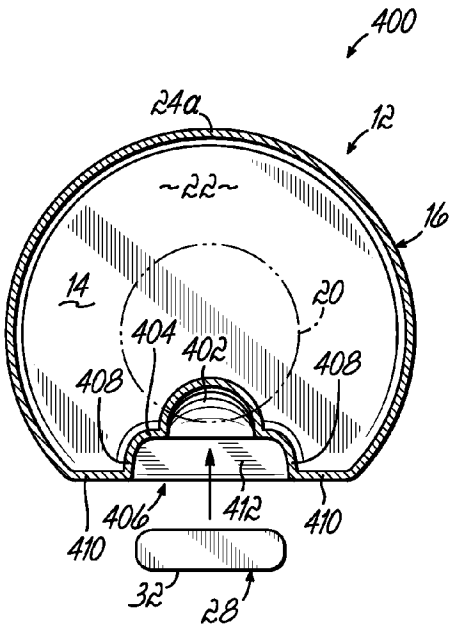
FIG. 3B is a cross-sectional view of the package system of FIG. 3, taken along line 3B-3B of FIG. 3.
Figure 3A:
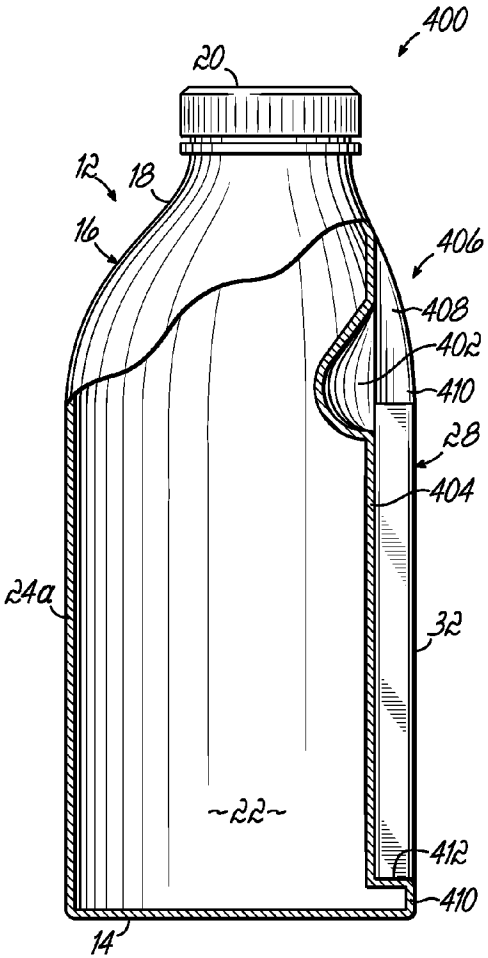
FIG. 3A is a cross-sectional view of the package system of FIG. 3, taken along line 3A-3A of FIG. 3.
Figure 3:
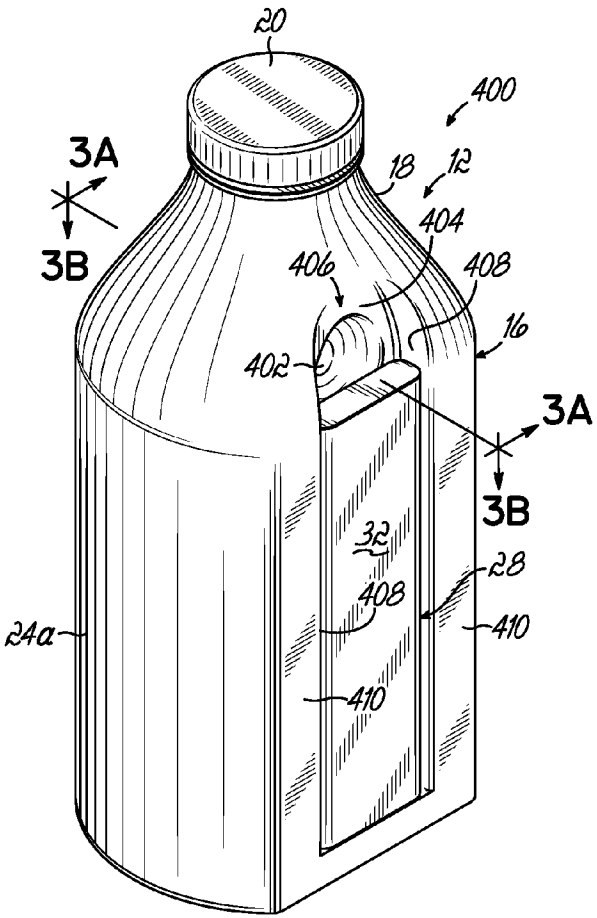
FIG. 3 is a perspective view of a package system according to an alternative embodiment of the present invention showing a single undercut communicating with the recess to facilitate removal of the article from within the recess.

In the alternative package system 400 of FIGS. 3, 3A and 3B, wherein like numbers represent like parts to the package system 10 of FIGS. 1, 1A and 1B, a single undercut 402 is formed in the recessed wall 404 and communicates with the recess 406. As in the package system 300, the undercut 402 has a depth which is greater than the depth of the recess 406 to permit one or more fingers to be inserted into the undercut and behind the article 28 to facilitate grasping and removal of the article from the recess 406. In this embodiment, the recess 406 may be open at both ends, similar to recess 26 as shown in the package system 10 of FIGS. 1, 1A and 1B or, alternatively, the recess 406 may open vertically only at its upper end as shown in FIGS. 3, 3A and 3B. The recess 406 has a pair of elongated side walls 408 which extend from the recessed wall 404 to the generally flat side wall 410 and a bottom wall 412. The bottom wall 412 of the recess 406 provides a surface upon which a lower end of the article 26 can engage and pivot when the article is dislodged from the recess 406.

Figure 4B:
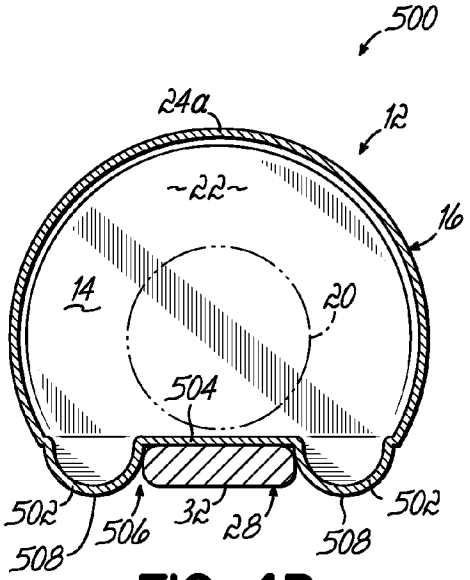
FIG. 4B is a cross-sectional view of the package system of FIG. 4, taken along line 4B-4B of FIG. 4.
Figure 4A:
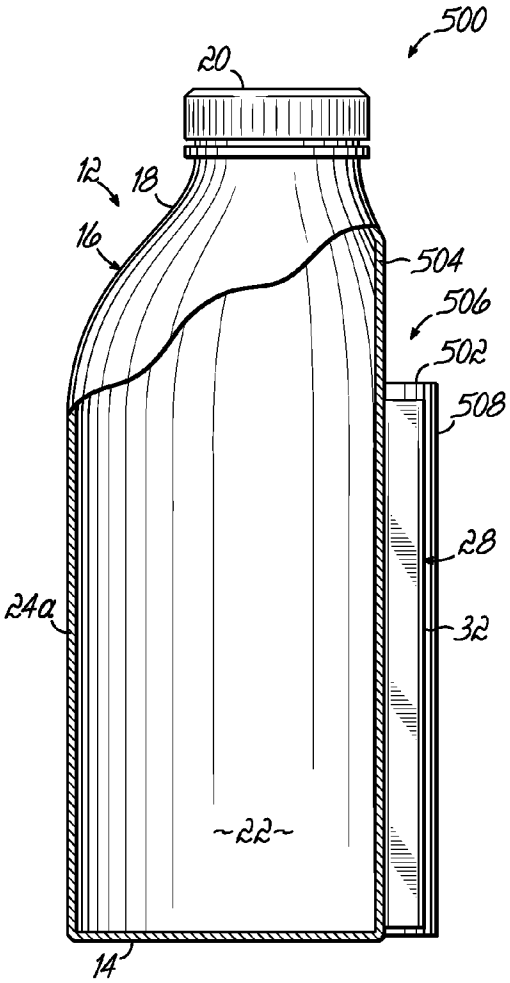
FIG. 4A is a cross-sectional view of the package system of FIG. 4, taken along line 4A-4A of FIG. 4.
Figure 4:
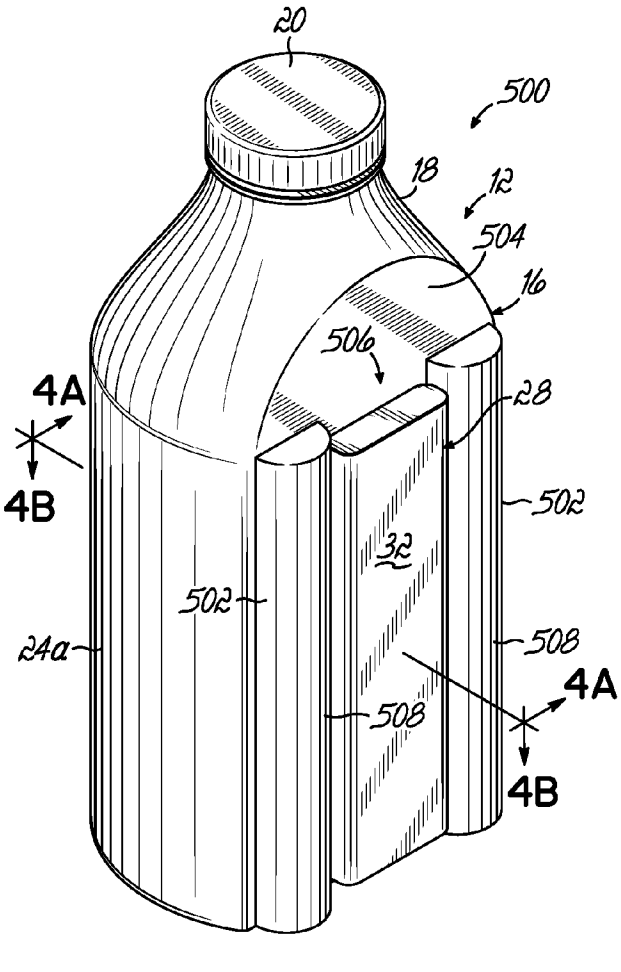
FIG. 4 is perspective view of a package system according to an alternative embodiment of the present invention showing a pair of spaced column members which define a recess therebetween for receiving an article in nested relationship within the recess.

Referring now to FIGS. 4, 4A and 4B, an alternative package system 500 is shown in accordance with the principles of the present invention, wherein like numbers represent like parts to the package system 10 of FIGS. 1, 1A and 1B. In this embodiment, the package system 500 includes a pair of spaced column members 502 which are integrally formed with the generally flat side wall 504 and which extend outwardly from the side wall 504. A recess 506 is formed between the column members 502 which opens vertically at its opposite ends. The recess 506 is configured to receive an article 28 in nested relationship within the recess 506 such that outermost portions 508 of the column members 502 extend outwardly effectively beyond the exposed surface 32 of the article 28 when the article is received within the recess 26 so as to protect the article. In this embodiment, the outermost portions 508 of the column members 502 are shown in FIGS. 4, 4A and 4B as extending entirely beyond the exposed surface 32 of the article 28. It shall be understood, however, that the outermost portions 508 of the column members 502 need only effectively, i.e., not entirely, extend beyond the exposed surface 32 of the article 28 so as to provide the desired protection of the article 28 in accordance with the principles of the present invention.

Figure 5B:
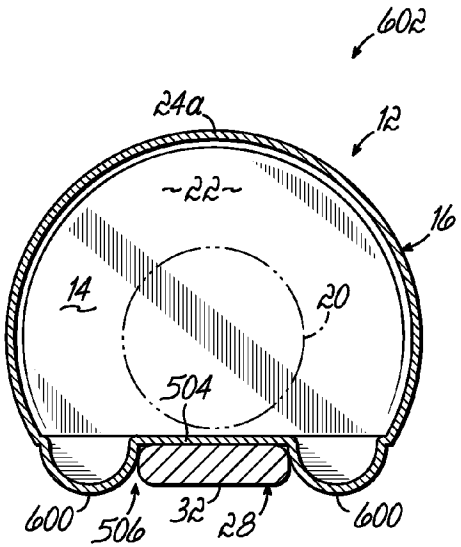
FIG. 5B is a cross-sectional view of the package system of FIG. 5, taken along line 5B-5B of FIG. 5.
Figure 5A:
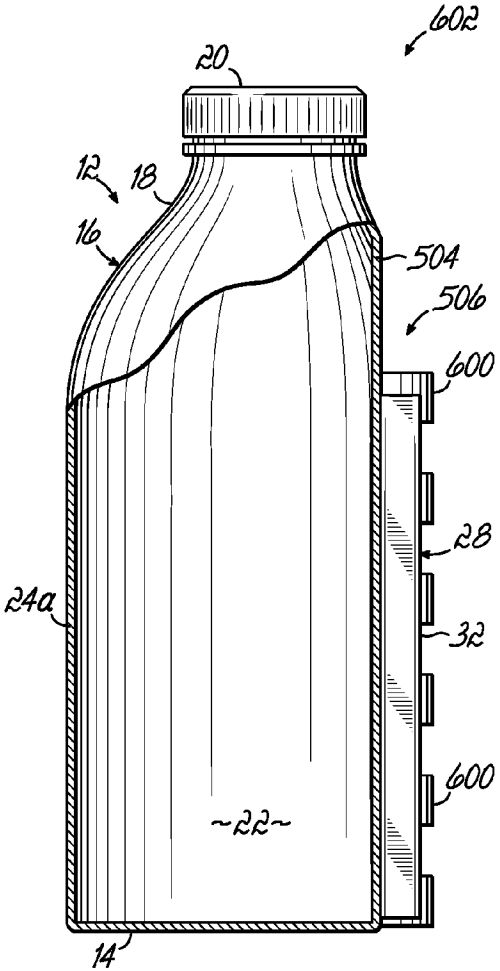
FIG. 5A is a cross-sectional view of the package system of FIG. 5, taken along line 5A-5A of FIG. 5.
Figure 5:
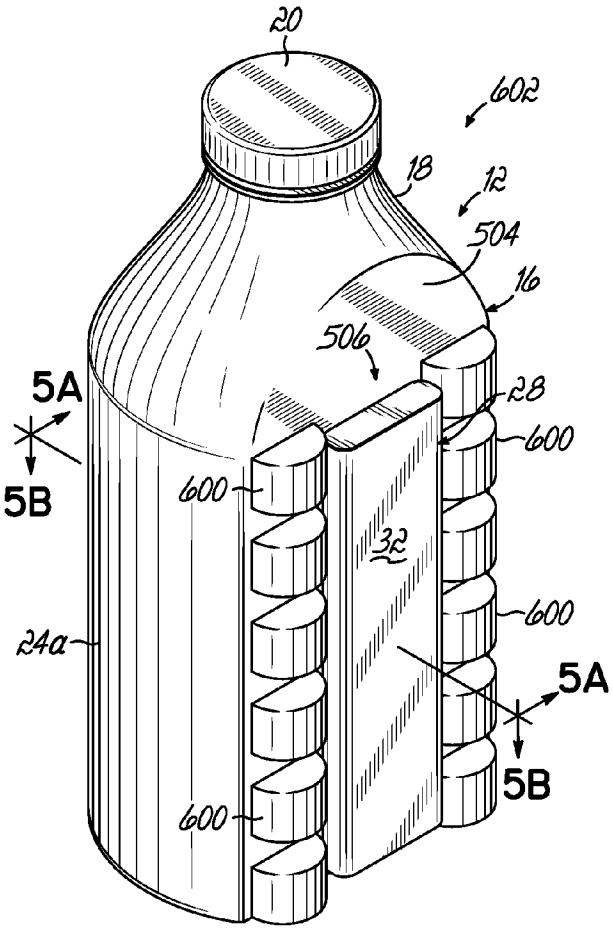
FIG. 5 is a perspective view of a package system according to an alternative embodiment of the present invention showing segmented column members.

The column members 502 may have many various shapes and sizes and provide an additional advantage when one package system is stacked on top of a similarly configured package system as will be described in greater detail below in connection with the package system of FIGS. 13 and 13A-C. The column members 502 add structural integrity to the packaging system 500 to resist vertical compression of stacked package systems and also add increased lateral crush resistance to the package system. The column members 502 may be continuous along their entire lengths as shown in FIGS. 4, 4A and 4B or, alternatively, the column members may be segmented into discrete column members 600 as shown in package system 602 of FIGS. 5, 5A and 5B. In either configuration, the column members 502 and 600 protect the article 28 against damage in accordance with the principles of the present invention.

Figure 9A:
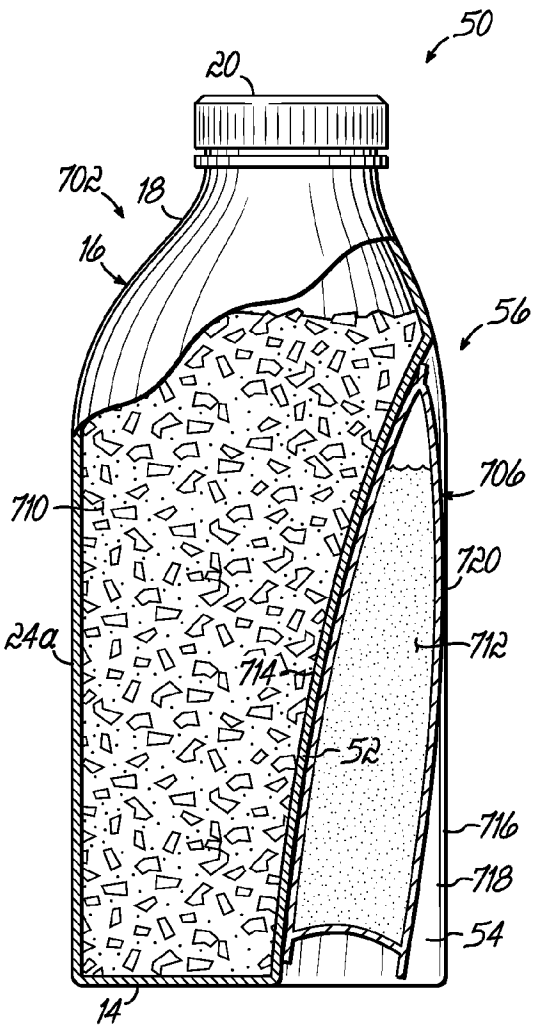
FIG. 9A is a cross-sectional view of the package system of FIG. 9, taken along line 9A-9A of FIG. 9.
Figure 9:
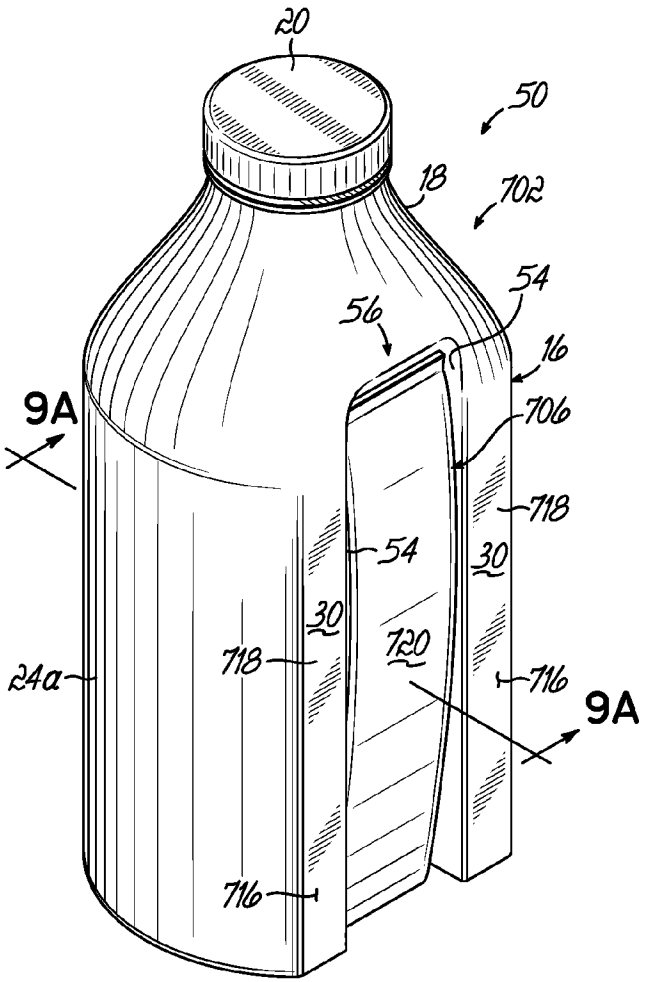
FIG. 9 is a perspective view of a package system according to an alternative embodiment of the present invention showing a flexible article secured in nested relationship within a recess of the container.

As shown in the alternative package system 50 of FIGS. 9 and 9A, the container 702 has the recess 56 formed therein which is configured to receive a flexible container 706 in nested relationship within the recess 56. In this embodiment, the container 706 is filled with particulate solids 710, and the flexible container 706 is filled with a liquid 712. Due to the bulging configuration of the flexible container 706, the recessed wall 714 of the recess 56 is arcuate and extends substantially into the body of the container 702. The recess 56 is configured with a sufficient depth such that portions 716 of the generally flat side wall 718 of the container 702 extend outwardly effectively beyond an exposed surface 720 of the flexible container 706 so as to protect the flexible container 706 against damage in accordance with the principles of the present invention.

Now referring to the alternative package system 800 of FIGS. 14, 14A and 14B, the container 802 is shown as a folded carton having a generally box-like shape. The container 802 in this embodiment has a recess 804 formed therein which is configured to receive an article 806 in nested relationship within the recess 804. As in the other embodiments described in detail above, the recess 804 is configured with a sufficient depth such that portions 810 of the generally flat side wall 812 of the container 802 extend outwardly effectively beyond an exposed surface 32 of the article 28 so as to protect the article 28 against damage in accordance with the principles of the present invention.

Figure 13C:
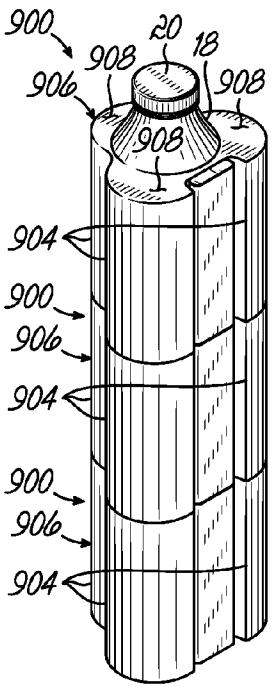
FIG. 13C is a perspective view of similarly configured package systems as shown in FIG. 13 stacked one on top of another.
Figure 13B:
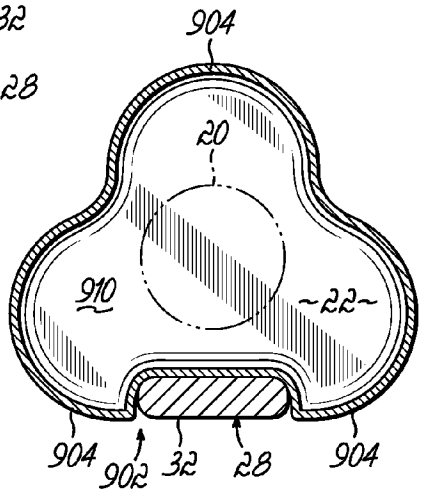
FIG. 13B is a cross-sectional view of the package system of FIG. 13, taken along line 13B-13B of FIG. 13.
Figure 13A:
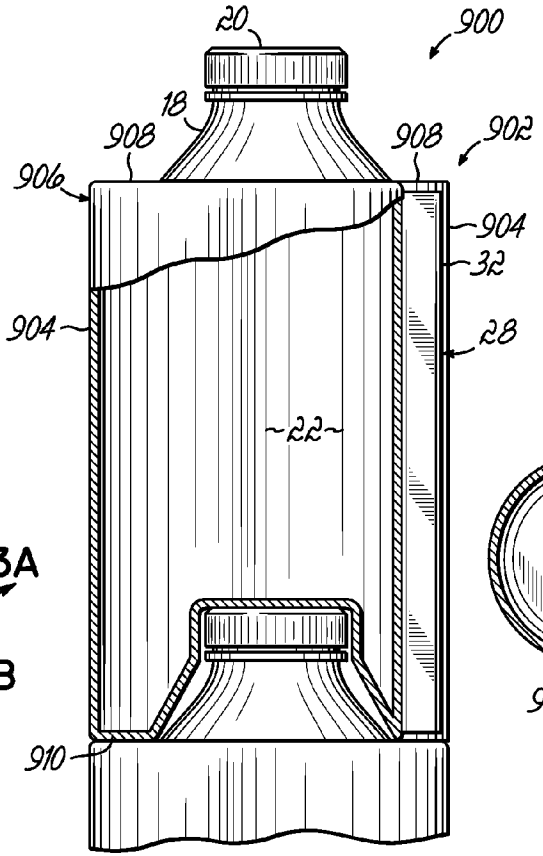
FIG. 13A is a cross-sectional view of the package system of FIG. 13, taken along line 13A-13A of FIG. 13.
Figure 13:
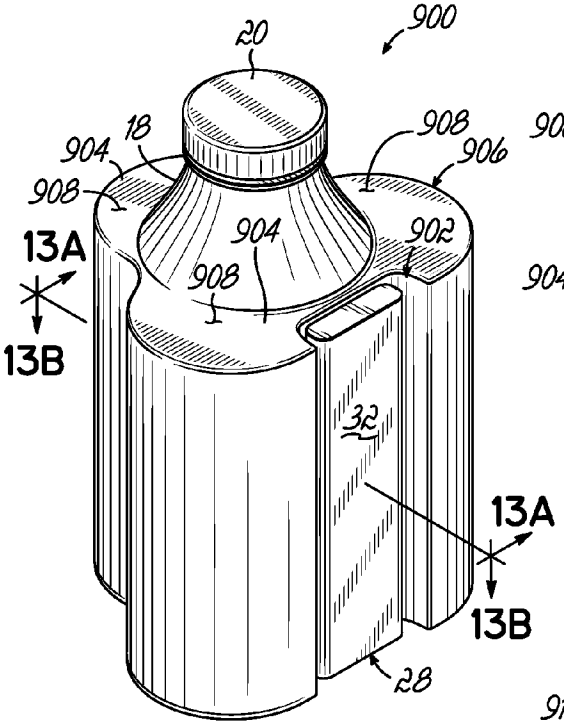
FIG. 13 is a perspective view of a package system according to an alternative embodiment of the present invention showing a stackable container and an article secured in nested relationship within a recess of the container.

FIGS. 13 and 13A-C illustrate an alternative package system 900 in accordance with the principles of the present invention. In this embodiment, a recess 902 is formed between a pair of spaced column members 904 and is configured to receive an article 28 in nested relationship within the recess 902. An additional column member 904 is provided on the container 906 in an area remote from the recess 902. The column members 904 may have a generally flat top wall 908 as shown or, alternatively, the top walls 908 may be rounded or have any other suitable shape. In this embodiment, the bottom wall 910 of the container 906 is configured to receive an upper portion of a similarly configured container 906 so as to permit stacking of similarly configured containers 906 one on top of the other as shown in FIGS. 13A and 13C. While shown as being rounded in FIGS. 13, 13B and 13C, the column members 904 may have a rectangular cross-sectional shape as shown in FIGS. 14 and 14B or any other suitable cross-sectional shape which permits stacking of the containers 906. The stacking and nesting configuration of the containers 906 is applicable to each of the container embodiments described above.

Further referring to the package system 900 of FIGS. 13 and 13A-C, the column members 904 extend substantially the entire height of the container 906. When the containers 906 are stacked as shown in FIGS. 13A and 13C, the top walls 908 of the column members 904 engage the bottom wall 910 of a container 906 which is stacked thereupon so that the column members 904 bear the compression load when the containers 906 are loaded in stacked relationship. The column members 904 also resist lateral compression of the containers 906 when the containers 906 are packaged together in a shipping container and transported from a manufacturer to a retail site for example.

While not shown, it is contemplated in each package system described in detail above that a single lower portion or a pair of lower portions of the container may be sized and shaped to fit within one or both cup holders found in most vehicles to improve stability of the package system when used by a consumer while driving, it is also contemplated that temperature sensitive inks, pigments or other sensors may be provided on the package systems described to provide a visual indication of the package system's temperature. These various types of sensors may be applied to an outside surface of the package system to sense the temperature that food is kept at during refrigeration, as well during heating such as by microwave. Other types of sensor technologies, such as Radio Frequency Identification (RFID) sensors, may be provided with the package systems described above for electronic communication with a central host as well as to detect atmospheric conditions such as for freshness, package tracking, package safety and inventory control.

Figure 12:
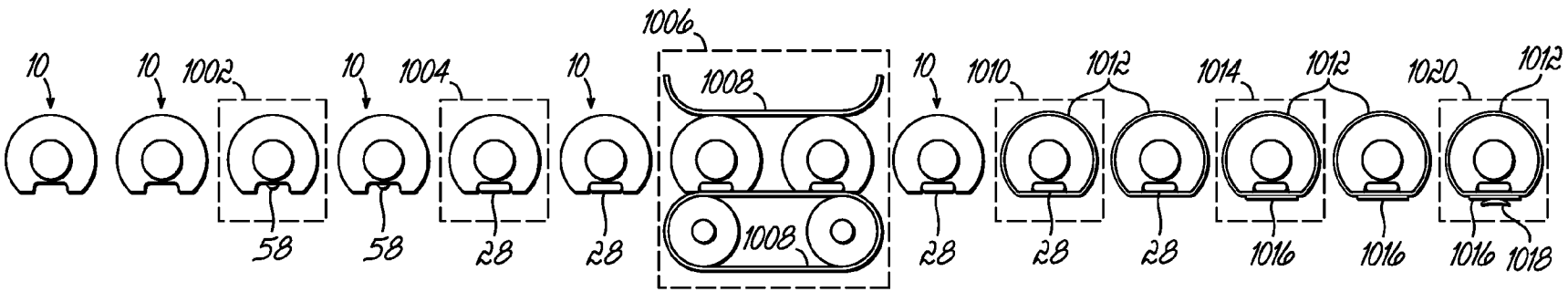
FIG. 12 is a diagrammatic view of an exemplary method for securing the article in nested relationship within the recess of the container.

Referring now to FIG. 12, an automated in-line process 1000 in accordance with one embodiment of the present invention is shown for securing the articles within the recesses of the package systems described in detail above. For example, referring to the package system 10 of FIGS. 1, 1A and 1B, the empty or filled containers 12 are transported in-line in a conventional manner to an adhering station 1002. At the adhering station 1002, adhering material 58, such as described in detail above, is placed upon or deposited onto the recessed wall 34 of the recess 26. While not shown, it will be appreciated that in an alternative embodiment, the adhering material 58 may be placed upon or deposited onto the inner surface 38 of the article 28 which is to confront the recessed wall 34 of the recess 26. Thereafter, the articles 28 are transported in-line to an insertion station 1004 so as to be inserted into the recesses 26 of the container 12. While not shown, it will be appreciated that the articles 28 may be inserted along a generally vertical insertion axis through either open end of the recess 26 or, alternatively, along a generally horizontal insertion axis toward the recesses 26 so that the articles 28 contact and are at least loosely held by the adhering material 58 within the recesses 26.

The package systems 10, including the combination of the containers 12 and the articles 28, are then transported to a compression system 1006 which compresses the package systems 10 between a pair of spaced compression belts 1008 or any other conventional compression device so that sufficient contact of the articles 28 with the adhering material 58 occurs to reliably secure the articles 28 to the container 12. Of course, other methods of integrating the articles 28 with the containers 12 known to those of ordinary skill in the art are possible as well without departing from the spirit and scope of the present invention.

Further referring to FIG. 12, after securement of the articles 28 within the recesses 26, the package systems 10 may be optionally transported to an overwrap station 1010 at which a substrate 1012, such as a polymeric band, tape, film, shrink-wrap or other substrate, may be applied to or about the containers 12 to at least partially overlie the recesses 26 and the nested articles 28 as described in detail above. The package systems 10 may be optionally transported to a second adhering station 1014. At the adhering station 1014, adhering material 1016 is placed upon or deposited onto the substrate 1012 which overlies the recesses 26 and the nested articles 28. Additional articles 1018, such as edible items, market premiums or other type of non-edible items, are transported in-line to insertion station 1020 where they are adhered to the adhering material 1016 on the outer surface of the substrate 1012.

It will be appreciated that in one embodiment of the present invention, the package systems described in detail above offer significant improvements in how meals are delivered and consumed from manufacturer to consumer. The package systems of the present invention deliver beverages, together with snacks and other foods, in a single integrated package. The present invention offers improved convenience and beverage/meal compact transport for consumers, as well as improved structural soundness, manufacturing, transport, and delivery efficiencies for manufacturers. Consumers also gain "grab and go" portability, as well as an improved visual appeal, tactile feel, and taste appeal. In addition, the package system of the present invention can also be made in a single integrated package that is vendable, delivering more healthy beverage/meal options to consumers wherever they are in their busy, "on the go" lifestyles.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Having described the invention, what is claimed is:

1. A method of securing an article in nested relationship within a recess of a container, comprising:

providing a container having a bottom wall and at least one upstanding side wall, defining a body portion, a neck portion and a shoulder portion tapering from the body portion to the neck portion, the container having an elongated recess defined by a recessed wall and a pair of elongated side walls formed in the body portion, the recess extending upwardly into the shoulder portion and opening vertically at opposite ends of the recess and being configured to be wider than it is deep substantially along its entire length;

applying an adhering material to one of the recess or an outer surface of the article;

moving the article in a direction toward and in general registration with the recess; and contacting the adhering material with the other one or the recess or the outer surface of the article so as to secure the article in nested relationship within the recess such that portions of the container side wall extend outwardly effectively beyond the article when the article is received within the recess.

2. The method of claim 1 wherein the contacting step comprises passing the article and container through a compression mechanism to urge the article into contact with the adhering material.

3. The method of claim 1 further comprising the step of at least partially overlying at least a portion of the recess and the article secured within the recess with a substrate.

4. The method of claim 3 further comprising the step of completely overlying the recess and the article secured within the recess with the substrate.

5. The method step of claim 4 further comprising the step of providing a recloseable seal with the substrate.

6. The method of claim 3 further comprising the step of forming at least one tear line in the substrate.

7. The method of claim 6 wherein the tear line defines a removable portion of the substrate.

8. A method of securing an article in nested relationship within a recess of a container, comprising:

providing a container having a bottom wall and at least one upstanding side wall, defining a body portion, a neck portion and a shoulder portion tapering from the body portion to the neck portion, the container having an elongated recess defined by a recessed wall and a pair of elongated side walls formed in the body portion, the recess extending upwardly into the shoulder portion and opening vertically at opposite ends of the recess and being configured to be wider than it is deep substantially along its entire length;

moving the article in a direction toward and generally in registration with the recess;

locating the article within the recess; and overlying at least a portion of the recess and the article located within the recess with a substrate so as to secure the article in nested relationship within the recess such that portions of the container side wall extend outwardly effectively beyond the article when the article is received within the recess.

9. The method of claim 8 further comprising the step of completely overlying the recess and the article located within the recess with the substrate.

10. The method step of claim 9 further comprising the step of providing a recloseable seal with the substrate.

11. The method of claim 8 further comprising the step of forming at least one tear line in the substrate.

12. The method of claim 11 wherein the tear line defines a removable portion of the substrate.

* * * * *